US008638185B1

(12) United States Patent
Lu

(10) Patent No.: US 8,638,185 B1
(45) Date of Patent: Jan. 28, 2014

(54) MAGNETICALLY-SENSITIVE SWITCH AND ELECTRONIC DEVICE WITH MAGNETICALLY-SENSITIVE SWITCH

(71) Applicants: Fu Tai Hua Industry (Shenzhen) Co., Ltd., Shenzhen (CN); Hon Hai Precision Industry Co., Ltd., New Taipei (TW)

(72) Inventor: Zhan-Sheng Lu, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/730,703

(22) Filed: Dec. 28, 2012

(30) Foreign Application Priority Data

Dec. 12, 2012 (CN) ..... 2012 1 0534189

(51) Int. Cl.
*H01H 9/00* (2006.01)

(52) U.S. Cl.
USPC ..... 335/205; 335/207

(58) Field of Classification Search
USPC ..... 335/205
See application file for complete search history.

(56) References Cited

U.S. PATENT DOCUMENTS

| | | | | | |
|---|---|---|---|---|---|
| 3,284,593 | A * | 11/1966 | Hawkins | 200/61.64 |
| 3,500,082 | A * | 3/1970 | Tolegian | 310/50 |
| 3,622,922 | A * | 11/1971 | Mogi | 335/2 |
| 3,720,895 | A * | 3/1973 | Schlesinger, Jr. | 335/205 |
| 3,729,697 | A * | 4/1973 | Hounsgard | 335/205 |
| 3,790,912 | A * | 2/1974 | Murphy | 335/205 |
| 3,950,719 | A * | 4/1976 | Maxwell | 335/205 |
| 4,596,971 | A * | 6/1986 | Hirabayashi et al. | 335/205 |
| 5,086,284 | A * | 2/1992 | Mouissie | 335/205 |
| 5,159,305 | A * | 10/1992 | Hutchinson | 335/207 |
| 5,283,402 | A * | 2/1994 | Green | 200/61.45 R |
| 5,332,992 | A * | 7/1994 | Woods | 340/547 |
| 5,646,587 | A * | 7/1997 | Miyazawa et al. | 335/205 |
| 5,673,021 | A * | 9/1997 | Woods | 340/547 |
| 5,877,664 | A * | 3/1999 | Jackson, Jr. | 335/205 |
| 6,246,307 | B1 * | 6/2001 | Friedman | 335/205 |
| 6,900,713 | B2 * | 5/2005 | Kasashima et al. | 335/207 |
| 7,190,247 | B2 * | 3/2007 | Zimmerling | 335/205 |
| RE39,731 | E * | 7/2007 | Woods | 340/547 |
| 7,532,096 | B2 * | 5/2009 | Zindler | 335/17 |
| 7,642,887 | B2 * | 1/2010 | Zimmerling | 335/296 |
| 7,924,125 | B2 * | 4/2011 | Nishiguchi et al. | 335/205 |
| 8,022,796 | B2 * | 9/2011 | Deininger et al. | 335/205 |
| 2006/0208839 | A1 * | 9/2006 | Taylor et al. | 335/205 |
| 2007/0219409 | A1 * | 9/2007 | Shimizu et al. | 600/112 |
| 2008/0258853 | A1 * | 10/2008 | Yamada et al. | 335/205 |

* cited by examiner

*Primary Examiner* — Shawki S Ismail
*Assistant Examiner* — Lisa Homza
(74) *Attorney, Agent, or Firm* — Altis Law Group, Inc.

(57) ABSTRACT

A magnetically-sensitive switch includes a housing, a metal block, a sling block, a rigid link, a first plate and an electrical switch. The housing includes a top wall, a bottom wall and two opposite sidewalls. A pair of sliding grooves is defined in the opposite sidewalls. The metal block is placed on the bottom wall. The sliding block is slidably connected to the sliding grooves. The rigid link is pivotally interconnected between the metal block and the sliding block. The first plate is attached to the housing. When the metal block is attracted by a magnetic force generated by a magnet placed adjacent to the top wall. The metal block is movable adjacent to the top wall, thereby driving the rigid link to drive the sliding block to slide towards the side opening along the sliding grooves until the sliding block triggers the electrical switch to generate a switching signal.

7 Claims, 5 Drawing Sheets

MAGNETICALLY-SENSITIVE SWITCH AND ELECTRONIC DEVICE WITH MAGNETICALLY-SENSITIVE SWITCH

BACKGROUND

1. Technical Field

The present disclosure relates to electronic devices and, particularly, to an electronic device with a sensor sensitive to magnetism which functions as a switch.

2. Description of Related Art

A switch to be physically pressed is usually used in an electronic device for generating signals to control the electronic device. However, the pressing switch, over many use-cycles and over time, deteriorates or ceases to function altogether.

Therefore, what is need is an electronic device with a magnetically-sensitive switch to overcome the described limitations.

DETAILED DESCRIPTION

Figure 1:
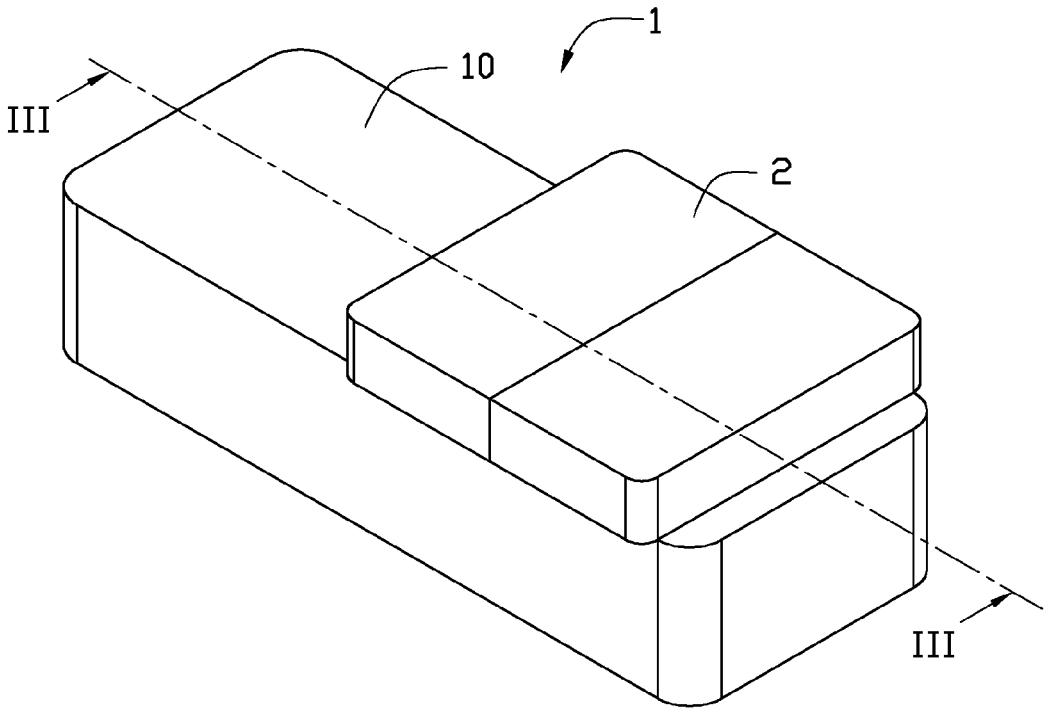
FIG. 1 is an isometric view of a magnetically-sensitive switch in accordance with an exemplary embodiment.
Figure 2:
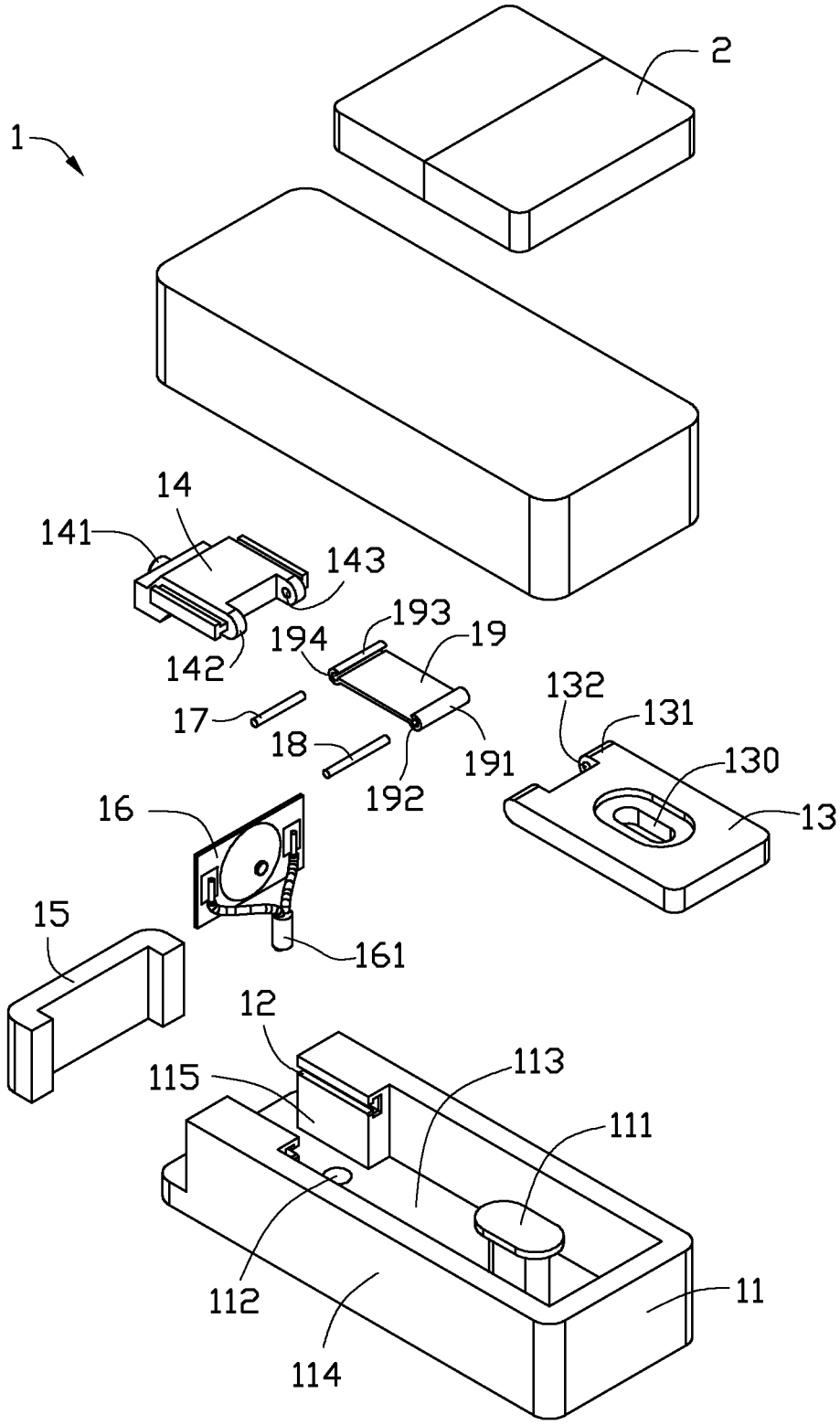
FIG. 2 is an exploded view of the magnetically-sensitive switch of FIG. 1.

Referring to FIGS. 1-2, a magnetically-sensitive switch 1 is provided. The magnetically-sensitive switch 1 includes a housing which includes a base 11 and a cover 10 placed over the base 11. The base 11 includes a bottom wall 113, and two opposite sidewalls 114 extending from the bottom wall 113. The base 11 defines a side opening 115 between the sidewalls 114. A pair of sliding grooves 12 is defined on opposite sidewalls of the base 11. The magnetically-sensitive switch 1 further includes a metal block 13 placed on the bottom wall 113 of the base 11, a sliding block 14 slidably engaged in the sliding grooves 12, a rigid link 19 pivotally interconnected between the metal block 13 and the sliding block 14, a first plate 15 attached to the housing to cover the side opening 3, and an electronic switch 16 fixed to the first plate 15 and arranged at the side opening 3.

A post 111 protrudes from the bottom wall 113 of the base 11. The metal block 13 defines a first through hole 130. The post 111 extends through the first through hole 130 of the metal block 13 to keep the metal block 13 horizontally captive but to allow vertical movement.

Two opposite first protrusions 131 are formed in one end of the metal block 13. A first pivot hole 132 is defined in the first protrusion 131. A first end 191 of the rigid link 19 is curved to form a first curving hole 192. The magnetically-sensitive switch 1 further includes a first shaft 18. The first end 191 of the rigid link 19 is placed between the two first protrusions 131. The first shaft 18 passes through the first curving hole 192 and the first pivot hole 132 to hinge the rigid link 19 to the metal block 13.

A second end 193 of the rigid link 19 is curved to form a second curving hole 194. Two opposite second protrusions 142 are formed in one end of the sliding block 14. A second pivot hole 143 is defined in the second protrusion 142. The magnetically-sensitive switch 1 further includes a second shaft 17. The second end 193 is placed between the two second protrusions 142. The second shaft 17 passes through the second curving hole 194 and the second pivot hole 143 to hinge the rigid link 19 to the sliding block 14. A resisting portion 141 protrudes from the sliding block 14, and triggers the electronic switch 16.

A second through hole 112 is defined in the bottom wall of the base 11. The electronic switch 16 includes an electrical cable 161 extending out of the base 11 through the second through hole 112 for electrically connecting to an electronic device.

Figure 3:
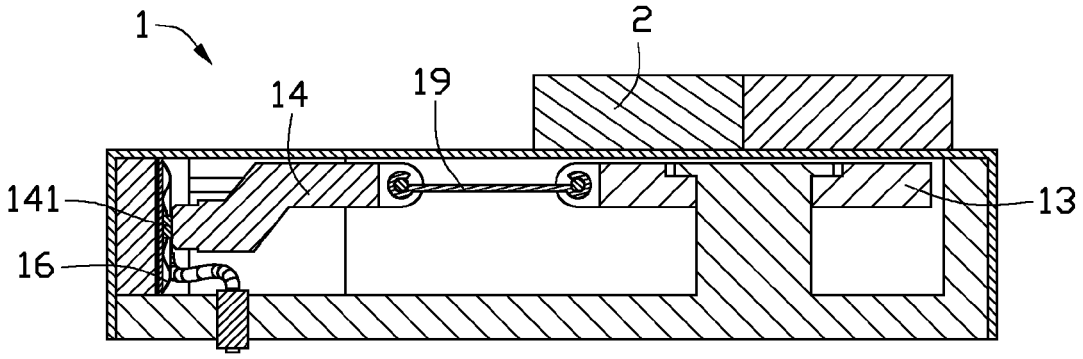
FIG. 3 is a sectional view of part of the magnetically-sensitive switch of FIG. 1, when triggered.

As referred to in FIG. 3, to trigger the magnetically-sensitive switch 1, the metal block 13 is attracted by a magnetic force generated by a magnet which is placed adjacent to a top wall of the cover 10, the metal block 13 is movable from the bottom wall of the base 11 to a raised position adjacent to the top wall of the cover 10, thereby the upward movement of the metal block 13 driving the sliding block 14 to slide toward the side opening 3 along the sliding grooves 12 until the resisting portion 141 of the sliding block 14 triggers the electrical switch 16 to generate a switching signal.

Figure 4:
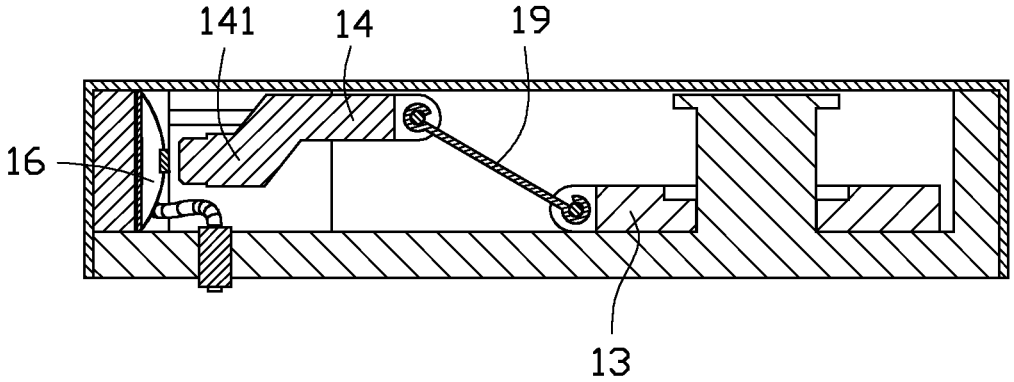
FIG. 4 is a sectional view of part of the magnetically-sensitive switch of FIG. 1, when not triggered.

As referred to in FIG. 4, to close the magnetically-sensitive switch 1, the magnet 2 is removed from the magnetically-sensitive switch 1, the magnetic force from the magnet 2 is thus released, the metal block 13 falls to the bottom wall 113 of the base 11, the rigid link 19 is driven by the metal block 13 to return to the bottom wall 113 of the base 11, the sliding block 14 is driven by the rigid link 19 to slide along the sliding grooves 12 away from the electrical switch 16 until the resisting portion 141 separates from the electrical switch 16.

Figure 5:
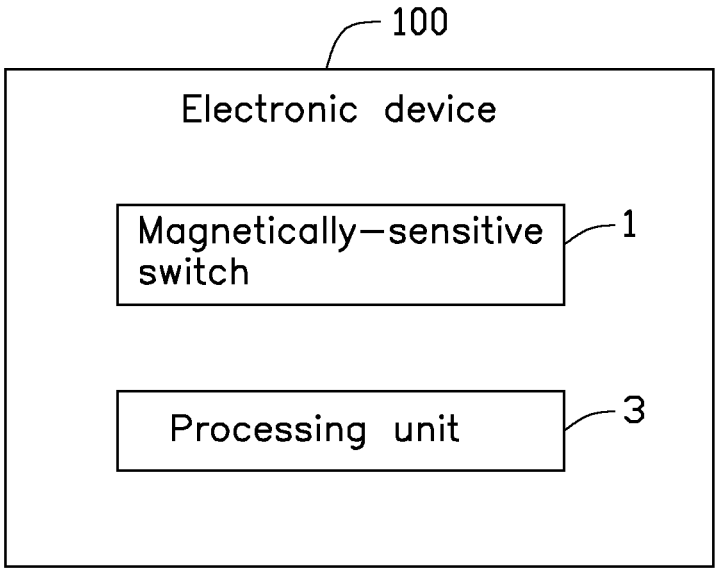
FIG. 5 is a schematic diagram of an electronic device including the magnetically-sensitive switch of FIG. 1.

As referred to FIG. 5, an electronic device 100 includes a processing unit 3 and the magnetically-sensitive switch 1. The processing unit 3 processes the switching signal generated by and from the magnetically-sensitive switch 1.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A magnetically-sensitive switch comprising:

a housing comprising a top wall, a bottom wall, two opposite sidewalls extending from the bottom wall and a pair of sliding grooves defined in the sidewalls, the housing defining a side opening between the sidewalls;

a metal block placed on the bottom wall of the housing;

a sliding block with opposite ends slidably engaged in the sliding grooves;

a rigid link pivotally interconnected between the metal block and the sliding block;

a first plate attached to the housing to cover the side opening; and an electrical switch fixed to the first plate and arranged at the side opening;

wherein, when the metal block is attracted by a magnetic force generated by a magnet which is placed adjacent to the top wall, the metal block is movable from the bottom wall of the housing to a raised position adjacent to the top wall, thereby the upward movement of the metal block driving the rigid link to drive the sliding block to slide toward the side opening along the sliding grooves until the sliding block triggers the electrical switch to generate a switching signal.

2. The magnetically-sensitive switch as described in claim 1, wherein a post protrudes from the bottom wall of the housing, a first through hole is defined in the metal block, the post extends through the first through hole of the metal block.

3. The magnetically-sensitive switch as described in claim 1, wherein the rigid link includes a first end hinged to the metal block.

4. The magnetically-sensitive switch as described in claim 1, wherein the rigid link includes an opposite second end hinged to the sliding block.

5. The magnetically-sensitive switch as described in claim 4, wherein a resisting portion protrudes from the sliding block and is configured to trigger the electronic switch.

6. The magnetically-sensitive switch as described in claim 1, wherein a second through hole is defined in the bottom wall of the housing, the electronic switch includes an electrical cable extending out of the housing through the second through hole for electrically connecting to an electronic device.

7. An electronic device comprising:

a processing unit; and a magnetically-sensitive switch as described in claim 1;

wherein the processing unit is configured for processing switching signal generated by and from the magnetically-sensitive switch.

* * * * *